US006422221B2

(12) United States Patent
Pietrowski et al.

(10) Patent No.: US 6,422,221 B2
(45) Date of Patent: Jul. 23, 2002

(54) INTAKE MANIFOLD WITH INTEGRATED EXHAUST GAS RECIRCULATION SYSTEM

(75) Inventors: Herbert Pietrowski, Pleidelsheim; Achim Rehmann, Kieselbronn, both of (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 09/773,923

(22) Filed: Feb. 2, 2001

(30) Foreign Application Priority Data

Feb. 2, 2000 (DE) ..... 100 04 552

(51) Int. Cl.[7] ..... F02B 47/10; F02M 35/104

(52) U.S. Cl. ..... 123/568.17; 123/184.61

(58) Field of Search ..... 123/184.42, 568.17, 123/184.61, 184.47, 568.11

(56) References Cited

U.S. PATENT DOCUMENTS

| | | | | | |
|---|---|---|---|---|---|
| 1,815,432 | A | * | 7/1931 | Deppe | 123/568.11 |
| 4,615,324 | A | * | 10/1986 | Choushi et al. | 123/568.17 |
| 4,715,329 | A | | 12/1987 | Yasuda et al. | |
| 5,273,010 | A | * | 12/1993 | Elder | 123/184.61 |
| 5,427,080 | A | * | 6/1995 | Maeda et al. | 123/568.17 |
| 5,492,093 | A | * | 2/1996 | Rygiel | 123/568.17 |
| 5,970,960 | A | | 10/1999 | Azuma | |
| 6,024,188 | A | * | 2/2000 | Yamaguchi et al. | 123/184.61 |
| 6,167,865 | B1 | * | 1/2001 | Ma et al. | 123/568.17 |

FOREIGN PATENT DOCUMENTS

| | | |
|---|---|---|
| DE | 19757986 A1 | 7/1999 |
| DE | 19819123 A1 | 11/1999 |
| FR | 2753256 | 3/1998 |
| JP | 6101587 | 4/1994 |
| JP | 9317579 | 12/1997 |
| JP | 11210563 | 8/1999 |
| WO | WO 97/34081 | 9/1997 |

* cited by examiner

*Primary Examiner*—Paul J. Hirsch
(74) *Attorney, Agent, or Firm*—Crowell & Moring LLP

(57) ABSTRACT

An intake manifold with an integrated exhaust gas recirculation system (16, 17*a*, 17*b*) which is located primarily within a plenum (12) of the intake manifold and is spaced at a distance (a) from the walls (20) of the intake manifold. This limits the heat transfer to the housing of the intake manifold, so that the housing may be manufactured, for example, of synthetic resin material. Further relief of the synthetic resin housing, particularly of the intake channels (14), from thermal stress is provided in that the intake air within the plenum cools the exhaust gas in the exhaust lines (17*a, b*), so that the intake-air/exhaust-gas mixture within the intake channels (14) does not exceed the critical temperature for the. synthetic resin walls (20) of the channels even if the exhaust gas recirculation rates are high.

13 Claims, 3 Drawing Sheets

INTAKE MANIFOLD WITH INTEGRATED EXHAUST GAS RECIRCULATION SYSTEM

BACKGROUND OF THE INVENTION

The invention relates to an intake manifold with an integrated exhaust gas recirculation system, which has a connection for the exhaust gas and inlet openings for the various intake channels.

Intake manifolds of this general type are known in the art. For example, WO 97/34081 discloses an intake manifold in which channels for exhaust gas recirculation are formed by grooves in the cylinder head flange. Once the intake manifold is mounted to the cylinder head, the cylinder head forms the missing wall of the exhaust gas recirculation channels.

Due to the thermal stresses that occur in the exhaust gas recirculation channels, at least the cylinder head flange of the intake manifold must be made of a heat-resistant material. This is a minor requirement in intake manifolds made of metal. But in intake manifolds made of synthetic resin or plastic material, which are a particularly cost-effective solution, the thermal stresses occurring in the exhaust gas recirculation system may cause damage.

To keep the thermal stresses in the synthetic resin intake manifold low, German patent application no. DE 198 19 123 A1 proposes to accommodate the exhaust gas recirculation system in a heat-resistant intermediate flange, which connects the cylinder head flange of the intake manifold with the cylinder head itself. This solution, however, implies a complex structure of the intake tract. The cost savings achieved by making the intake manifold of synthetic resin are reduced by the additional cost of the intermediate flange.

SUMMARY OF THE INVENTION

Thus, it is the object of the invention to provide an intake manifold with an integrated exhaust gas recirculation system, in which the thermal stress of the intake manifold due to exhaust gas recirculation is low.

This and other objects are achieved by the invention as described and claimed hereinafter.

The intake manifold according to the invention has the known structure comprising inlet, plenum, intake channels from the plenum, and outlets to the cylinders. The outlets may advantageously be formed as a cylinder head flange. The intake manifold may be designed for an in-line or V-type arrangement or any other type of arrangement of the cylinders. It is also possible to provide several plenums, which are assigned to corresponding groups of intake channels.

The intake manifold further has a connection for the exhaust gas recirculation system. Via an exhaust line, the exhaust is directed to inlet openings, which are arranged, respectively, within the flow region of the intake air influenced by the intake channels. This makes it possible to supply each cylinder separately with exhaust gas to ensure a desirable, particularly homogenous distribution of the exhaust gas over all cylinders. In the exhaust gas supply region, valves may be provided to permit a cylinder-selective introduction of the exhaust gas as a function of the cycle of the individual cylinders. The flow region influenced by the intake channels should be understood to mean the region that permits the supplied exhaust gas to a large extent to be assigned to an particular intake channel. Thus it refers to more than just the volume of the intake channel itself. The inlet openings can also be arranged within the volume of the plenum and in the proximity of the intake openings formed by the intake channels, which open out into the plenum. This essentially permits a clear assignment of the exhaust gas to the individual intake channels. As an alternative, however, a stoichiometric distribution of openings in the exhaust line is also possible. These openings achieve a uniform distribution of the exhaust gas in the intake air, which is subsequently supplied to the intake channels.

Particularly if there are several plenums, a plurality of connections and exhaust lines may be provided in the intake manifold. In the design of the intake manifold, the connections and the exhaust line advantageously provide some design latitude because fewer boundary conditions due to other components (e.g. injection valves, cylinder head cover, generators, pumps, fuel strips or clearances for screws) have to be taken into account when running the lines within the plenum. A further advantage is that the intake air flows around the exhaust line within the plenum. This makes it possible to cool the exhaust gas before it is introduced into the intake manifold. Cooling, however, does not need to be achieved by a separate channel system or a cooling medium that differs from the combustion air. Cooling therefore does not involve additional design complexity. Moreover, the tightness requirements of the exhaust gas duct in the intake manifold are lower since minor leaks merely cause earlier mixing of the exhaust gas with the intake air.

Ensuring a clearance between the exhaust line and the walls of the intake manifold prevents heat conduction between the exhaust line, which gets hot, and the material of the intake manifold. This greatly reduces the thermal stress of the intake manifold. Direct heat conduction is possible only via the fastening means or mounting members, which fix the exhaust line within the interior of the manifold. The mounting members used comprise at least one seal, which is required at the rim of a passage for the connection. The connection is thus located outside the intake manifold permitting a connection to the exhaust gas system of the internal combustion engine. Further mounting members for the exhaust line may include any of the means available in fastener technology. Feasible, for example, are screwed and riveted connections, as well as clamped, plug-in and snap-in connections. If the intake manifold has a multi-shell structure, the exhaust line may be fixed through the assembly of the shells of the intake manifold. Bars as spacers can minimize heat conduction with sufficient fixation. Further minimization is advantageously possible if the mounting members themselves do not conduct heat well. This can be achieved, in particular, by a small cross-section of the fastening means, which create a heat bridge between the intake manifold wall and the exhaust line, or by selecting materials with low thermal conductivity, e.g. ceramics.

In accordance with one particular embodiment of the invention, the fastening means used may also be the exhaust gas inlet openings of the exhaust line if they have to be run through the walls of the intake channels. This necessarily results in a connection between the exhaust line and the walls of the intake manifold, particularly the intake channels, by means of which the exhaust line can be fixed in position.

Such an arrangement of the inlet opening, which results in a defined exhaust gas admission into the intake air within the intake channels, can be improved by an advantageous design of the junction in the passages of the wall. For example, a bellows-form tube section may be used, which on the one hand, due to the enlarged surface of the bellows or the extension of the heat conduction path, results in thermal insulation of the exhaust line with respect to the intake manifold. The bellows-form tube section itself is suitable for transferring the exhaust gas and introducing it into the intake port. Furthermore, due to its elasticity, the bellows allows for a certain compensation of tolerances between the exhaust line and the intake manifold. This compensation is necessary because of the different thermal expansion of the materials of the exhaust line and the intake manifold and because of the different thermal stresses to which they are subjected. Instead of the tube section, a ceramic fitting may be used to ensure thermal insulation at least between the exhaust line and the intake manifold. The ceramic fitting furthermore permits any geometry of the inlet point, e.g. in the form of a nozzle. The geometry of the inlet point can then be designed to ensure optimal distribution of the exhaust gas within the intake air.

If the inlet openings, as mentioned above, are arranged in the region of the intake openings of the intake channels, heat conduction can be further reduced. It also permits a central inlet in relation to the cross section of the intake channels to ensure uniform distribution of the exhaust gas within the intake air. It moreover allows for large tolerances.

One advantageous embodiment of the exhaust line results if said line has a multi-shell construction. The shells may for instance consist of two deep-drawn metal parts, thereby permitting the realization of complex geometric structures of the exhaust line. In addition, further functional components may be integrated in the shells. Particularly flanges or spacers to fix the exhaust line within the interior of the intake manifold may be cost-effectively produced. The duct structure formed by the shells may be supplemented by further components that are mounted to the basic part. It is possible, for instance, to complete the exhaust line by connecting pipes to it.

Producing the exhaust line from a metallic material ensures good heat conduction from the exhaust to the intake air within the intake manifold. This allows for optimal cooling of the exhaust gas up to the inlet points, so that the walls of the intake manifold are subject to less thermal stress in the region of the inlet points. Metallic materials are furthermore highly heat-resistant and thus allow high recirculation rates of exhaust gas into the intake manifold. If thermal stress is low, a heat-resistant synthetic resinl, e.g. PPS, may be used for the exhaust line. This lowers the costs of fabrication and materials.

The intake manifold itself is advantageously made of synthetic resin maaterial. This permits cost-effective manufacture. Particularly when using multi-shell techniques, the exhaust line may be readily integrated into the intake manifold prior to final assembly of the intake manifold. Integration is also feasible, however, in synthetic resin intake manifolds produced by meltable core techniques. In this case, either an installation opening for the exhaust line has to be provided or the exhaust line has to be cast into the core in order to define its position within the interior of the intake manifold. The invention may of course also be used in intake manifolds that are made of metal, e.g. aluminum.

Advantageously, the geometry of the exhaust line within the intake manifold may be designed in such a way that the path traveled by the exhaust gas from the respective connection to the respective inlet opening to the intake channels is always the same length. This synchronizes the dead times that occur between the opening of the exhaust gas recirculation valve and the inflow of the exhaust gas into the intake channels. It furthermore achieves uniform cooling of the exhaust gas up to the individual inlet points. The combination of these effects optimizes pollutant reduction through exhaust gas recirculation. Furthermore, a possible reduction in engine torque, which could occur due to a short caused by the exhaust lines, is prevented. The length of the lines counteracts this in the form of a throttle.

These and other features of preferred further developments of the invention are indicated in the claims as well as in the description and the drawings. The individual features may be implemented alone or in various sub-combinations in embodiments of the invention as well as in other fields and may constitute advantageous and protectable embodiments per se, for which protection is hereby claimed.

BRIEF DESCRIPTION OF THE DRAWINGS

The invention will be described in further detail hereinafter with reference to illustrative preferred embodiments shown in the accompanying drawings in which.

DETAILED DESCRIPTION OF PREFERRED EMBODIMENTS

Figure 1:
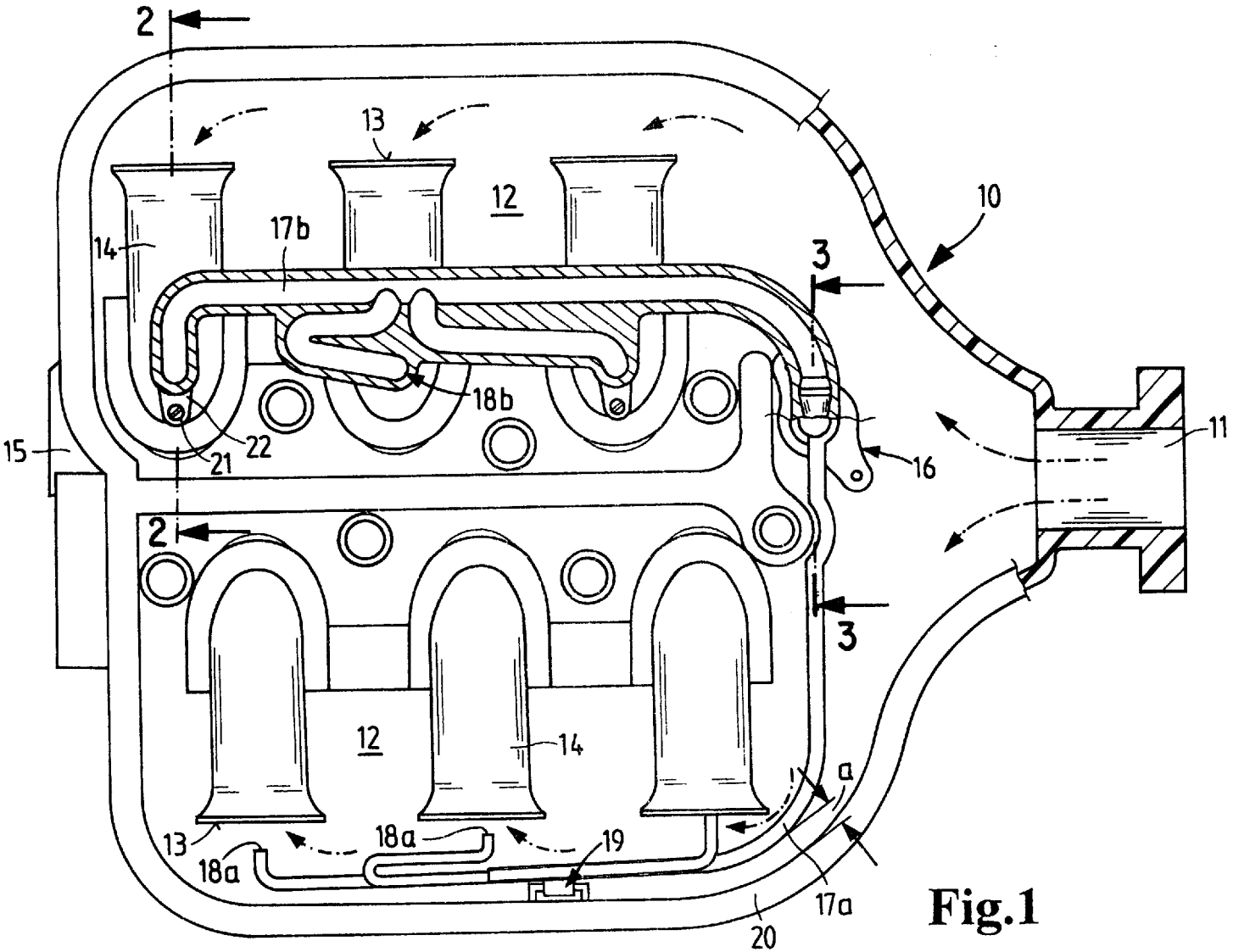
FIG. 1 is a partially cut away top view of an intake manifold for an internal combustion engine with V-type cylinder arrangement produced by a multi-shell technique, with the top cover removed.

FIG. 1 is a view onto a lower shell 10 of an intake manifold. It illustrates how the intake air flows in the direction of the arrows from an inlet 11 via two plenums 12 to intake openings 13 of intake channels 14 which lead to the outlets (not depicted) of a cylinder head flange 15.

From a connection 16, an exhaust line 17*a, b*, depicted in two variants in FIG. 1, leads to inlet openings 18*a, b*, which allow the introduction of the exhaust gas into the intake air flow in the region of the intake channels. The exhaust line 17*a* is fastened to a wall 20 of the intake manifold by means of a snap connection 19. This ensures a minimum clearance (a) between wall 20 and exhaust line 17*a*, which contributes to the thermal protection of wall 20. The exhaust line 17*b* is fastened within the intake manifold by means of screws 21 and brackets 22.

Figure 2:
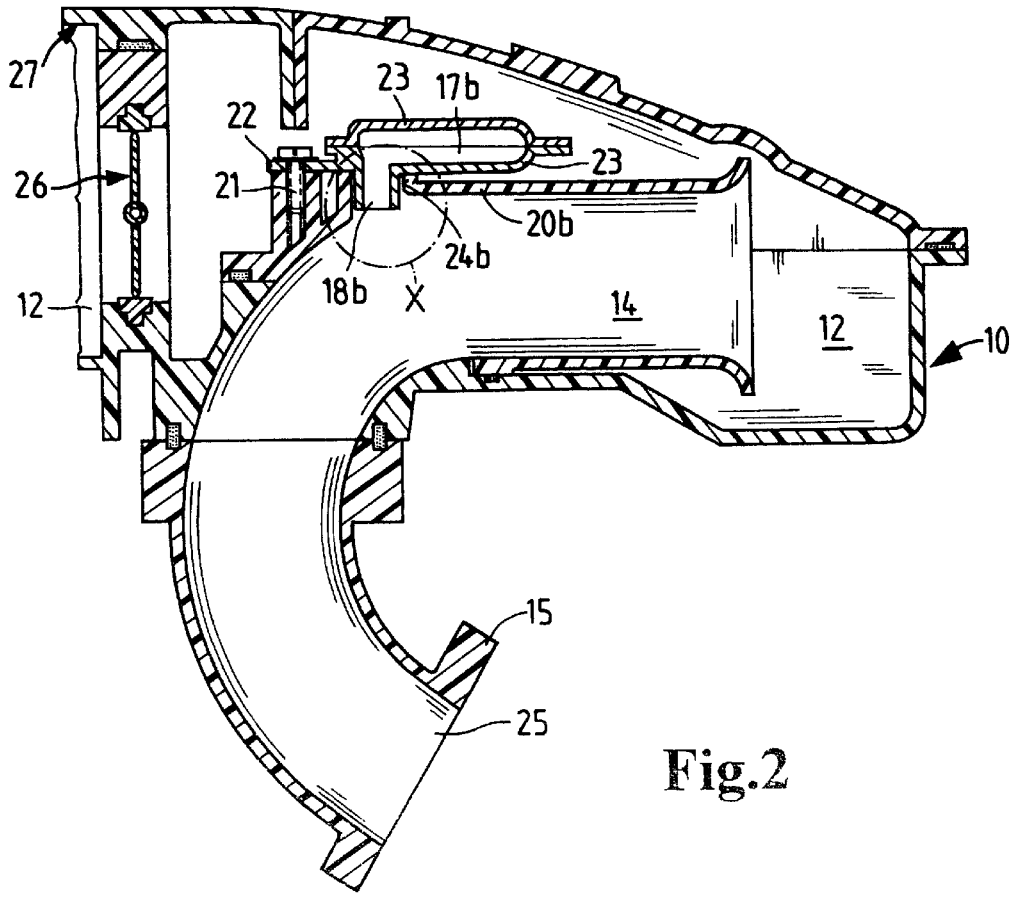
FIG. 2 is a sectional view taken along line A—A of FIG. 1.

The structure of the exhaust line 17*b* is further illustrated by FIG. 2. It is composed of two mated concave shells 23, which create the hollow space to guide the exhaust gases. Bracket 22 for fastening the exhaust line is also an integral component of one of the shells. The inlet opening 18*b* is inserted in a passage 24*b* in wall 20*b* of the corresponding intake port 14. At this point, the exhaust gas is added to the intake air, which flows to one of the outlets 25 in the cylinder head flange 15.

The intake manifold is fabricated and welded in a multi-shell technique. The intake channels 14 are welded into the lower shell 10. Furthermore, a resonance flap 26 as a connection between the two plenums 12 and exhaust line 17*b* must be installed in the lower shell. Finally, an upper shell 27 is welded to the lower shell 10.

Figure 3:
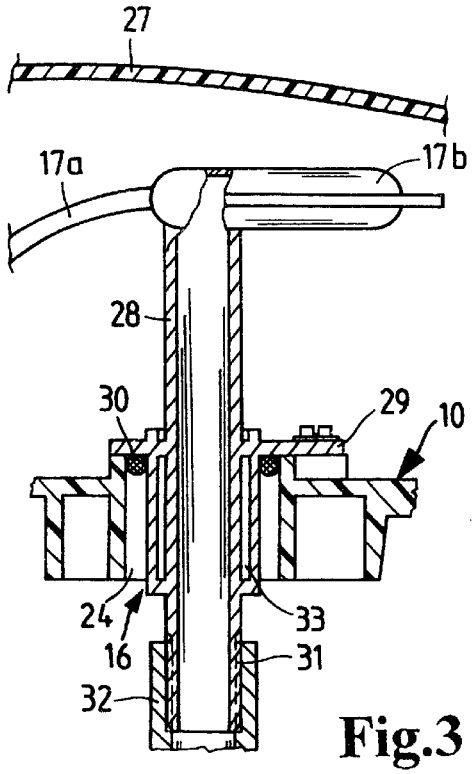
FIG. 3 is a sectional view taken along line B—B of FIG. 1, depicting two variants of the exhaust line.

FIG. 3 is a detail of the connection 16 in a cutaway view. The connection comprises a pipe stub 28, which is fixed in a passage 24 by means of a mounting flange 29. A seal 30 in the form of an O-ring is arranged within the passage. On the one side the pipe opens out into a threaded connecting piece 31 which allows an exhaust intake line 32 to be connected, and on the other side into exhaust line 17*a, b* (In the Figure, both versions of exhaust line are shown). To minimize heat conduction into the lower shell 10, the pipe stub has a bell-shaped hollow profile 33 in the region of passage 24.

Figure 4:
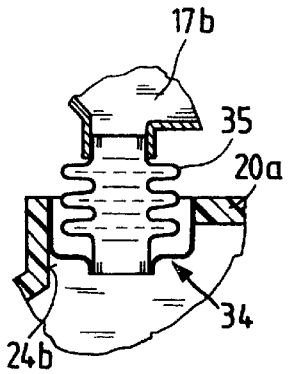
FIGS. 4 and 5 are variants of detail X of FIG. 2.
Figure 5:
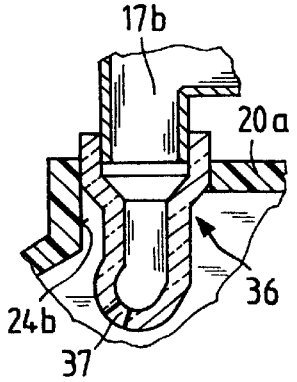

The inlet openings 18*b* in the passages 24*b* may also be designed to prevent heat conduction from the exhaust line to the wall 20*b* of the intake channels 14. In FIG. 4 the inlet is formed as a tube section 34 comprising a sheet metal bellows 35. The exhaust line 17*b* is mounted to this tube section. The tube section in turn is inserted into passage 24*b*. Instead of the tube section, a ceramic fitting 36 may be used. This fitting may be freely designed. At its end, a nozzle 37 is formed, which causes a targeted introduction of the exhaust gas. This nozzle is oriented corresponding to the curvature of the intake port 14 in the flow direction of the intake air. As a result, the introduced exhaust gas is immediately carried along and is optimally distributed within the intake air.

Figure 6:
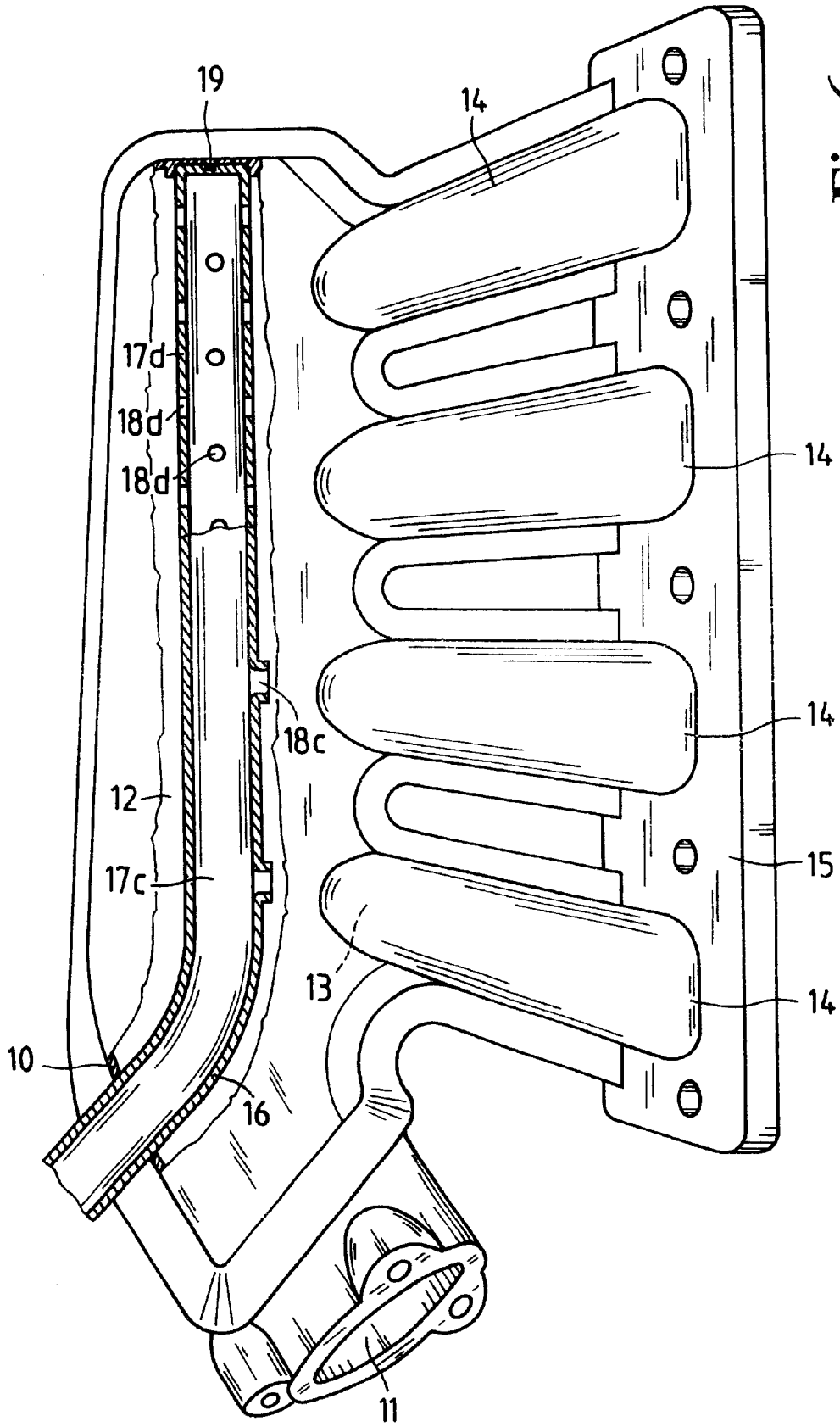
FIG. 6 shows two variants of an exhaust gas recirculation line built into the plenum of an intake manifold in a cutaway view.

FIG. 6 shows a further example of an intake manifold. A portion of the plenum 12 is cut away, so that two variants of an exhaust line 17*c* and 17*d* are visible. The exhaust line is mounted in fixed position by connection 16 and snap connection 19. The inlet openings 18c of the one variant open out into the intake openings 13 of the intake channels 14, as described above. The inlet openings 18*d* are stoichiometrically or regularly distributed over the surface of the exhaust line 17*d* and thus lead to a uniform, thorough mixing the recirculated exhaust gas with the intake air before it reaches the intake channels 14.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. An intake manifold with an integrated exhaust gas recirculation system, comprising at least one air inlet leading to a plenum, a plurality of air intake channels leading from the plenum to outlets to respective cylinders of an engine, an exhaust line leading from an exhaust connection to exhaust gas inlet openings which are arranged in regions of intake air flow influenced by respective air intake channels, wherein the exhaust line is disposed inside an interior cavity of the intake manifold and attached by mounting members such that the exhaust line is spaced a distance from walls of the intake manifold, and wherein a seal is provided between the exhaust line and a passage through a wall of the intake manifold.

2. An intake manifold according to claim 1, wherein the seal is provided between the exhaust connection and an outer wall of the intake manifold plenum.

3. An intake manifold according to claim 1, wherein the seal is provided between the exhaust line adjacent each exhaust gas inlet opening and a wall of each respective intake channel.

4. An intake manifold according to claim 1, wherein the exhaust line mounting members restrict thermal conduction between the exhaust line and the intake manifold.

5. An intake manifold according to claim 1, wherein at least some of the exhaust line mounting members are installed in passages through walls of the intake channels and form exhaust inlet openings through which recirculated exhaust gas is admitted into intake air flowing through the air intake channels.

6. An intake manifold according to claim 5, wherein said at least some mounting members comprise bellows-form tube sections which are installed in the passages through the walls of the intake channels and which permit exhaust gas from the exhaust line to enter the air intake channels.

7. An intake manifold according to claim 5, wherein said at least some mounting members comprise ceramic fittings which are installed in the passages through the wall of the intake channels and which exhaust gas from the exhaust line to enter the intake channels.

8. An intake manifold according to claim 1, wherein the exhaust gas inlet openings are arranged adjacent respective air intake openings from the plenum into the air intake channels.

9. An intake manifold according to claim 1, wherein at least part of the exhaust line has a multi-shell structure such that the exhaust line has a hollow cross section formed by abutting concave shells.

10. An intake manifold according to claim 1, wherein the exhaust line has a branched structure such that the paths traversed by exhaust gas from said exhaust connection to each of the respective exhaust gas inlet openings are substantially equal in length.

11. An intake manifold with an integrated exhaust gas recirculation system, comprising at least one air inlet leading to a plenum, a plurality of air intake channels leading from the plenum to outlets for respective cylinders of an engine, an exhaust line leading from an exhaust connection to exhaust gas inlet openings which open into the plenum, wherein the exhaust line is disposed inside the plenum of the intake manifold and attached by mounting members such that the exhaust line is spaced a distance from walls of the intake manifold; wherein a seal is provided between the exhaust line and a passage through a wall of the intake manifold, and wherein the exhaust gas inlet openings are arranged in such a way as to ensure homogenous mixing of exhaust gas with intake air flowing through the intake manifold and to obtain a substantially uniform concentration of exhaust gas in the intake air in regions of intake air flow influenced by respective air intake channels.

12. An intake manifold according to claim 11, wherein the seal is provided between the exhaust connection and an outer wall of the intake manifold plenum.

13. An intake manifold according to claim 11, wherein the seal is provided between the exhaust line adjacent each exhaust gas inlet opening and a wall of each respective intake channel.

* * * * *